US009349510B2

(12) United States Patent
Lo et al.

(10) Patent No.: US 9,349,510 B2
(45) Date of Patent: May 24, 2016

(54) POSITIVE TEMPERATURE COEFFICIENT DEVICE

(71) Applicant: POLYTRONICS TECHNOLOGY CORP., Hsinchu (TW)

(72) Inventors: Kuo Chang Lo, New Taipei (TW); Yao Te Chang, Linnei Township, Yunlin County (TW)

(73) Assignee: POLYTRONICS TECHNOLOGY CORP., Hsinchu (TW)

( * ) Notice: Subject to any disclaimer, the term of this patent is extended or adjusted under 35 U.S.C. 154(b) by 0 days.

(21) Appl. No.: 14/619,822

(22) Filed: Feb. 11, 2015

(65) Prior Publication Data

US 2016/0035468 A1 Feb. 4, 2016

(30) Foreign Application Priority Data

Jul. 30, 2014 (TW) ..... 103125979 A

(51) Int. Cl.

| | |
|---|---|
| ***H01C 7/10*** | (2006.01) |
| ***H01C 7/13*** | (2006.01) |
| ***H01C 17/065*** | (2006.01) |
| ***H01C 7/02*** | (2006.01) |

(52) U.S. Cl.

CPC ..... *H01C 17/06586* (2013.01); *H01C 7/027* (2013.01)

(58) Field of Classification Search

CPC ..... H01C 7/021; H01C 7/027; H01C 7/02; H01C 7/13

USPC ..... 338/22 R, 13, 328, 320

See application file for complete search history.

(56) References Cited

U.S. PATENT DOCUMENTS

| | | | | |
|---|---|---|---|---|
| 5,945,034 | A | 8/1999 | Handa et al. | |
| 6,143,206 | A | 11/2000 | Handa et al. | |
| 6,299,801 | B1 | 10/2001 | Handa et al. | |
| 6,452,476 | B1 * | 9/2002 | Handa | H01B 1/22 252/511 |
| 6,607,679 | B2 | 8/2003 | Handa et al. | |
| 6,778,062 | B2 | 8/2004 | Handa et al. | |
| 7,352,272 | B2 * | 4/2008 | Wang | H01B 1/22 252/511 |
| 7,382,224 | B2 * | 6/2008 | Wang | H01C 7/027 219/548 |
| 8,525,636 | B1 * | 9/2013 | Sha | H01C 17/06526 338/22 R |

FOREIGN PATENT DOCUMENTS

| | | | |
|---|---|---|---|
| CN | 100433203 | C | 11/2008 |
| TW | I271750 | B | 1/2007 |

* cited by examiner

*Primary Examiner* — Kyung Lee

(74) *Attorney, Agent, or Firm* — Egbert Law Offices, PLLC

(57) ABSTRACT

A PTC device comprises two electrode layers and a PTC material layer laminated therebetween. The PTC material layer has a volumetric resistivity less than 0.2 Ω-cm, and comprises a crystalline polymer, conductive ceramic fillers and crystalline low molecular weight organic compound. The crystalline polymer comprises thermoplastic polymer, thermosetting polymer or combination thereof. The conductive ceramic fillers dispersed in the crystalline polymer have volumetric resistivity less than 500 μΩ-cm, and comprise 40-70% by volume of the PTC material layer. The crystalline low molecular weight organic compound has a molecular weight less than 5000, and comprises 6-30% by volume of the PTC material layer. The hold current at 60° C. divided by a covered area of the PTC device is greater than 0.2 A/mm$^2$, the hold current at 60° C. is 40-95% of the hold current at 25° C., and the trip temperature of the PTC device is less than 95° C.

13 Claims, 1 Drawing Sheet

POSITIVE TEMPERATURE COEFFICIENT DEVICE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present application relates to a positive temperature coefficient (PTC) device of which the resistance increases as temperature rises. The PTC device is suitably applied to temperature sensors and over-current protection.

2. Description of Related Art Including Information Disclosed Under 37 CFR 1.97 and 37 CFR 1.98.

Because the resistance of conductive composite materials having positive temperature coefficient (PTC) characteristic is very sensitive to temperature variation, it can be used as the material for current sensing devices, and has been widely applied to over-current protection devices or circuit devices. The resistance of the PTC conductive composite material remains extremely low at normal temperature, so that the circuit or cell can operate normally. However, when an over-current or an over-temperature event occurs in the circuit or cell, the crystalline polymer of the PTC conductive composite material will melt and expand to sever a lot of conductive paths and therefore the resistance instantaneously increases to a high resistance state (i.e., trip) to decrease the current.

It is highly demanded for over-current and over-temperature protections the PTC device has low resistance at room temperature, large resistance variation between room temperature and trip temperature and superior resistance repeatability after repetitive trips.

The PTC device usually uses carbon-series conductive fillers such as carbon black and graphite; however it is necessary to use a lot of carbon-series conductive fillers to meet low resistance requirement. As a result, the PTC device may not trip if a large amount of carbon black are used and therefore it may be not qualified for over-current or over-temperature protection.

This shortcoming may be overcome by using metal conductive fillers, e.g., nickel, of which the resistance is much lower than that of the carbon-series fillers. However, it was observed that the resistance of the PTC device at room temperature gradually increases over time, and therefore the reliability for long-term operation is not satisfactory. It is believed that the metal conductive fillers would be oxidized and thus the electrical conductivity becomes lower.

U.S. Pat. No. 6,778,062 discloses an organic PTC thermistor comprising an organic polymer matrix and conductive metal particles dispersed therein. The conductive metal particles are pretreated with an organic material. The organic material is different from the organic polymer matrix, does not covalently bond with the conductive metal particles, and is not compatible at a molecular level with the organic polymer matrix, so that an organic material layer covers surfaces of conductive metal particles to avoid oxidation whereby resistance stability is improved. However, the conductive metal particles have to be pretreated in advance, and therefore the process becomes more complicated. Furthermore, the process stability and quality of the conductive metal particles would be hard to control, and these problems affect the electrical performance of the PTC thermistor.

U.S. Pat. Nos. 5,945,034, 6,143,206, 6,299,801 and 6,452,476 disclose polymeric PTC thermistors comprising polymer matrix, low-molecular weight organic compound and conductive metal particles dispersed in the polymer matrix, wherein the melting point of the low molecular weight organic compound is 40-100° C. U.S. Pat. No. 6,607,679 discloses a polymeric PTC thermistor having a low-molecular weight organic compound such as wax, fat or oil. The PTC effect of all the aforesaid patents is attributed to the polymer matrix, and does not disclose or teach the way to induce PTC effect by melting and expansion of low-molecular weight organic compound nor by narrowing melting temperature distribution range of the low-molecular weight organic compound, i.e., increasing the concentration of melting point, to acquire large hold current and low trip temperature of the PTC thermistor.

U.S. Pat. No. 8,525,636 discloses a polymeric PTC thermistor comprising a polymer matrix and high conductive ceramic particles dispersed therein. The hold current per unit area (hold current/covered area) of the PTC thermistor at 60° C. is about 0.16-0.8 A/mm$^2$, and the hold current at 60° C. is 40-95% of the hold current at 25° C. Likewise, the disclosure does not teach the way to cause PTC effect by melting and expansion of low-molecular weight organic compound nor by increasing the concentration of melting point to acquire both high hold current and low trip temperature of the PTC thermistor.

BRIEF SUMMARY OF THE INVENTION

The present application provides a PTC device having accurate trip temperature range, and therefore it can precisely control trip temperature. Hence, in addition to the applications of over-current protection, the PTC device is suitable for temperature sensor applications.

According to an embodiment of the present application, a PTC device comprises two electrode layers and a PTC material layer laminated therebetween. The PTC material layer has a volumetric resistivity less than 0.2 Ω-cm, and comprises a crystalline polymer, conductive ceramic fillers and crystalline low-molecular weight organic compound. The crystalline polymer comprises thermoplastic polymer, thermosetting polymer or combination thereof. The conductive ceramic fillers dispersed in the crystalline polymer have volumetric resistivity less than 500 μΩ-cm, and comprise 40-70% by volume of the PTC material layer. The crystalline low-molecular weight organic compound has a molecular weight less than 5000, and comprises 6-30% by volume of the PTC material layer. The hold current at 60° C. divided by a covered area of the PTC thermistor is greater than 0.2 A/mm$^2$, the hold current at 60° C. is 40-95% of the hold current at 25° C., and trip temperature of the PTC device is less than 95° C.

In an embodiment, the thermoplastic polymer of the crystalline polymer is selected from the group consisting of polyolefins, ethylene-vinyl acetate copolymer, ethylene-acrylic acid copolymer, halogenated polymer, polyamide, polystyrene, polyacrylonitrile, polyethylene oxide, polyacetal, thermoplastic modified celluloses, polysulfone, thermoplastic polyester, poly(ethyl acrylate), poly(methyl methacrylate), thermoplastic elestomer, and polymer containing ions of zinc, magnesium, copper, iron or aluminum.

In an embodiment, the thermosetting polymer is selected from the group consisting of epoxy resins, unsaturated polyester resins, polyimide, polyurethane, phenolic resins, and silicone resins.

In an embodiment, the crystalline low-molecular weight organic compound has a melting point in the range of 70-110° C. and a narrow melting temperature distribution range. For example, the temperature distribution range is less than 20° C., preferably less than 10° C., and more preferably less than 6° C. The melting temperature distribution range is a temperature range from onset point to offset point of the crystalline low-molecular weight organic compound. In a Differential Scanning calorimetry (DSC) diagram of the low-molecular weight organic compound, the onset point and offset point are determined by the intersections of two inclined lines, which start from the peak and extend along or tangent to endothermic curve, and the baseline of the curve.

In an embodiment, the crystalline low-molecular weight organic compound is selected from the group consisting of paraffin waxes, microcrystalline waxes, vegetable waxes, animal waxes, mineral waxes, fatty acids, stearic acid, palmitic acid, fatty esters, fatty acid esters, polyethylene waxes, amide, stearic acid amide, behenic acid amide, N,N'-ethylene-bislauric acid amide, N,N'-dioleyladipic acid amide, N,N'-hexamethylenebis-12-hydroxystearic acid amide and mixtures thereof.

In an embodiment, the crystalline low-molecular weight organic compound comprises hydrocarbons, fatty acids, fatty esters, fatty acid amides, aliphatic amines, n-alkyl alcohols having 12 or more carbon atoms, and chlorinated paraffin. In an embodiment, the aliphatic amine is aliphatic primary amines having 4 or more carbon atoms.

In an embodiment, the crystalline low-molecular weight organic compound comprises recrystallized wax having a single melting point.

In an embodiment, the crystalline low-molecular weight organic compound has a structure of $R^1$—C(O)—NH—$R^2$, where $R^1$, $R^2$ are saturated alkyl or aryl having between 4-24 carbon atoms.

In an embodiment, the conductive ceramic fillers comprise titanium carbide (TiC), tungsten carbide (WC), vanadium carbide (VC), zirconium carbide (ZrC), niobium carbide (NbC), tantalum carbide (TaC), molybdenum carbide (MoC), hafnium carbide (HfC), titanium boride ($TiB_2$), vanadium boride ($VB_2$), zirconium boride ($ZrB_2$), niobium boride ($NbB_2$), molybdenum boride ($MoB_2$), hafnium boride ($HfB_2$), zirconium nitride (ZrN), titanium nitride (TiN), solid solutions thereof or mixtures thereof. The particle size of the conductive ceramic fillers is about 0.01 μm to 30 μm, and preferably about 0.1 μm to 10 μm.

In an embodiment, the crystalline low-molecular weight organic compound has a molecular weight preferably less than 3000.

In an embodiment, the trip temperature of the PTC device is measured under a condition that 6 volts and 1 ampere are applied thereto.

Given the higher crystallinity of the crystalline low-molecular weight organic compound, the resistance of the PTC device dramatically increases, i.e., trip event, within a precise temperature range. By narrowing melting temperature distribution range of the crystalline low-molecular weight organic compound, i.e., increasing the concentration of the melting point, the high hold current at 60° C. and low trip temperature can be attained simultaneously. As such, the PTC device of the present application is suitably applied to temperature sensor applications.

BRIEF DESCRIPTION OF THE SEVERAL VIEWS OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 1:
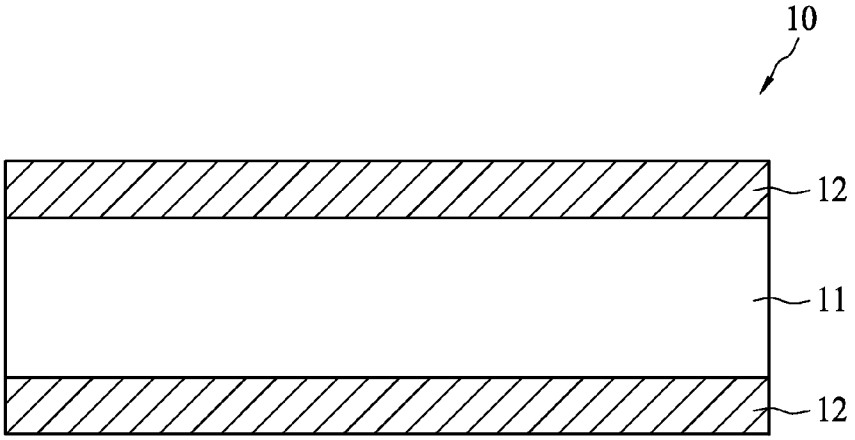
FIG. 1 shows a PTC device of the present application.

FIG. 1 shows a structure of a PTC device of the present application. A PTC device 10 comprises two electrode layers 12 and a PTC material layer 11 laminated therebetween. The PTC material layer 11 comprises crystalline polymer, conductive ceramic fillers and crystalline low-molecular weight organic compound. The crystalline polymer serves as a matrix of the PTC material layer 11, and the conductive ceramic fillers and the crystalline low-molecular weight organic compound are dispersed therein. It is noted that the crystallinity of the low-molecular weight organic compound is usually higher than that of other ordinary polymers. When temperature increases to the melting point of the low-molecular weight organic compound, the low-molecular weight organic compound expands to accordingly incur the expansion of the entire material, resulting in a PTC trip event. Because of narrow melting temperature distribution range of the low-molecular weight organic compound, the resistance of the PTC device increases dramatically within the narrow melting temperature range. It is advantageous to use two or more low-molecular weight organic compounds of different melting points to adjust the trip temperature of the PTC device. The melting point and the trip temperature of the crystalline polymer vary with the change of the molecular weight or crystallinity. However, varying with the crystalline states may cause unsatisfactory PTC characteristics. This problem becomes obvious when the trip temperature is set at 100° C. or lower.

The composition and manufacturing process of the present application are exemplified below. Table 1 shows the composition and volume percentage of the PTC material layer, in which the crystalline polymer comprises thermoplastic polymer and/or thermosetting polymer. For example, low density polyethylene (LDPE), high density polyethylene (HDPE), polyvinylidene fluoride (PVDF) or mixtures thereof. In an embodiment, conductive ceramic fillers have volumetric resistivity less than 500 μΩ-cm, e.g., titanium carbide and/or tungsten carbide, and have an average particle size about 0.1 to 10 μm and an aspect ratio less than 100 or preferably less than 20 or 10. The conductive ceramic fillers may have various shapes such as spherical, cubic, flake, polygonal, or column shapes. In the embodiment, the crystalline low-molecular weight organic compound uses waxes or amide compounds of melting points at 70-110° C. The wax of the comparative examples (Comp. 3-5) is Degussa Vestowax EH100 (A-0, without recrystallizing treatment). This wax exhibits two melting points of 58° C. and 102° C. The melting point of the wax starts from 50° C. and ends at 106° C., and thus the melting temperature distribution range is about 56° C. Because the melting temperature distribution is too broad and exceeds 20° C., the wax needs to be melted and recrystallized to fractionate the wax of high melting point. Accordingly, the fractionated wax has narrower melting temperature range. The fractionation process includes the steps of (1) mixing Degussa Vestowax EH100 and a solvent xylene with a weight ratio 1:4; (2) heating up to 100° C. so as to dissolve the majority of wax into xylene, and filtering out undissolved wax; (3) heating up to 120° C. to dissolve the wax into the xylene completely, cooling to 80° C. and sustaining for 8 hours for recrystallizing wax; (4) filtering to collect recrystallized wax; and (5) vacuuming, drying and then collecting the filtered and dried wax. The steps (1) to (5) are repeated. After five times recrystallization, the recrystallized wax (A-5) employed in the embodiments (Em. 1-6) has a melting point of about 90° C. and the melting temperature distribution range is about 10° C. As such, the crystalline low-molecular weight organic compound has narrow melting temperature distribution range, and exhibits single melting point behavior.

Figure 2:
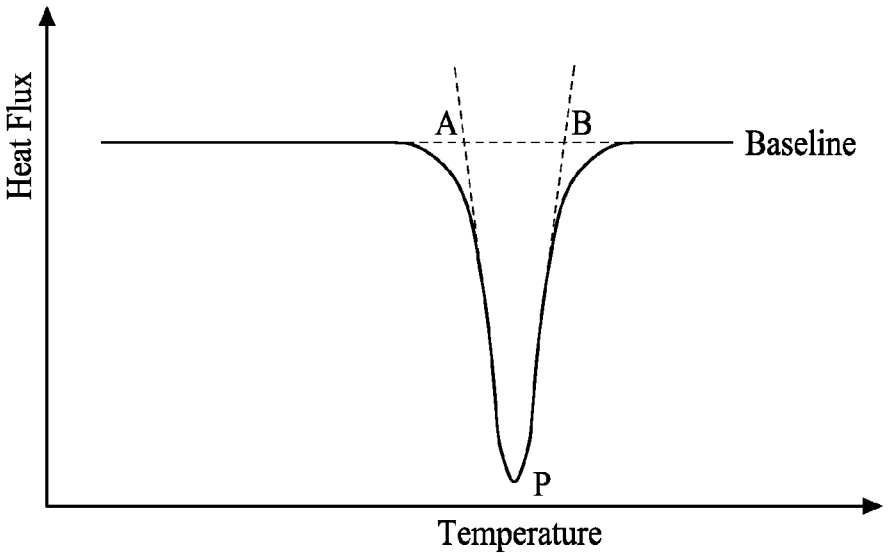
FIG. 2 shows a melting temperature distribution range of the PTC device.

The melting temperature distribution range is a temperature range of a compound melting from the beginning to the end. The onset point and offset point are determined according to a DSC diagram of the compound. The onset point and the offset point are the temperatures corresponding to the two intersections of two lines, which start from the peak or hilltop and extend along or tangent to the hillsides of the endothermic curve, and the baseline of the curve. As shown in FIG. 2, two lines from the peak "P" of the endothermic curve and along or tangent to the hillsides of the curve intersect the baseline at points "A" and "B." The melting temperature distribution range is the difference between the temperature corresponding to "B" and the temperature corresponding to "A." The melting temperature is the temperature corresponding to "P."

The crystalline low-molecular weight organic compound may use amide compound (Em. 6, low-molecular weight organic compound "B"). The amide compound is formed by amide reaction of organic acid and organic amine. For example, octadecylamine reacts with benzyl acid to form octadearyl benzyl amide of which the melting point is about 78.5° C. and the melting temperature distribution range is about 5° C.

TABLE 1

| | Polymer | | Low-molecular weight compound | | | Conductive filler | |
|---|---|---|---|---|---|---|---|
| | HDPE (vol %) | LDPE (vol %) | A-0 (vol %) | A-5 (vol %) | B (vol %) | WC (vol %) | TiC (vol %) |
| Em. 1 | 20 | — | — | 20 | — | — | 60 |
| Em. 2 | 19 | 5 | — | 16 | — | — | 60 |
| Em. 3 | 46.8 | — | — | 8.2 | — | 45 | — |
| Em. 4 | 36.3 | 10.1 | — | 8.6 | — | 45 | — |
| Em. 5 | 20.7 | 9 | — | 25.3 | — | 45 | — |
| Em. 6 | 37 | 9 | — | 5 | 4 | 45 | — |
| Comp. 1 | 32 | 8 | — | — | — | — | 60 |
| Comp. 2 | 55 | — | — | — | — | 45 | — |
| Comp. 3 | 33 | — | 22 | — | — | 45 | — |

TABLE 1-continued

| | Polymer | | Low-molecular weight compound | | | Conductive filler | |
|---|---|---|---|---|---|---|---|
| | HDPE (vol %) | LDPE (vol %) | A-0 (vol %) | A-5 (vol %) | B (vol %) | WC (vol %) | TiC (vol %) |
| Comp. 4 | 11 | 28 | 16 | — | — | 45 | — |
| Comp. 5 | 38.2 | — | 16.8 | — | — | 45 | — |

In an embodiment, the manufacturing process of the PTC composition is described as follows. The raw material is fed into a blender (HAAKE 600) at 160° C. for two minutes. The procedure of feeding the raw material includes adding the crystalline polymer with the amounts according to Table 1 into the blender; after blending for a few seconds, then adding the conductive ceramic filler and the non-conductive crystalline low-molecular organic compound. The rotational speed of the blender is set at 40 rpm. After blending for three minutes, the rotational speed increases to 70 rpm. After blending for 7 minutes, the mixture in the blender is drained and thereby a conductive composition with PTC characteristic is obtained.

The above conductive composition is loaded symmetrically into a mold with outer steel plates and a 0.35 mm thick middle, wherein the top and the bottom of the mold are disposed with a Teflon cloth. The mold loaded with the conductive composition is pre-pressed for three minutes at 50 kg/cm$^2$ and 180° C. Then the generated gas is exhausted and the mold is pressed for 3 minutes at 100 kg/cm$^2$, 180° C. Next, another press step is performed at 150 kg/cm$^2$ and 180° C. for three minutes to form a PTC material layer 11, as shown in FIG. 1. In an embodiment, the thickness of the PTC material layer 11 is 0.3 mm or 0.35 mm.

The PTC material layer 11 may be cut into many square pieces each with an area of 20×20 cm$^2$. Then two electrode layers 12, e.g., metal foils, are pressed to physically contact the top surface and the bottom surface of the PTC material layer 11, in which the two electrode layers 12 are symmetrically placed upon the top surface and the bottom surface of the PTC material layer 11. Next, buffers, Teflon cloths and the steel plates are placed on the metal foils and are pressed to form a multi-layered structure. The multi-layer structure is pressed again at 180° C. and 70 kg/cm$^2$ for three minutes, and is subjected to 50-500 KGy radiation for PTC material crosslinking Next, the multi-layered structure is punched or cut to form a PTC device (PTC chip) 10 with an area of 2.3 mm×2.3 mm, 2.5 mm×3 mm or 3 mm×5 mm. In an embodiment, the electrode layers 12 may contain rough surfaces with nodules. More specifically, the PTC device 10 is a laminated structure and comprises two electrode layers 12 and a PTC material layer 11 sandwiched therebetween.

In addition to titanium carbide and tungsten carbide employed in the embodiments, the conductive ceramic fillers may comprise vanadium carbide, zirconium carbide, niobium carbide, tantalum carbide, molybdenum carbide, hafnium carbide, titanium boride, vanadium boride, zirconium boride, niobium boride, molybdenum boride, hafnium boride, zirconium nitride, titanium nitride, solid solutions thereof or mixtures thereof. The particle size of the conductive ceramic fillers is in the range of 0.01 μm to 30 μm, and preferably 0.1 μm to 10 μm.

The technical data of the embodiments and comparative examples in Table 1 are listed in Table 2 below, including resistances at 25° C., hold currents at 25° C. (I-hold@25° C.), hold currents at 60° C. (I-hold@60° C.) and trip temperatures.

The so-called hold current is the maximum current the PTC device can withstand without trip at a specific temperature. The trip temperatures are measured by applying a voltage of 6V and a current of 1 A to the PTC device 10.

TABLE 2

| | Resistance @ 25° C. (Ω) | Size (mm × mm) | I-hold @ 25° C. (A) | I-hold @ 60° C. (A) | I-hold @ 60° C./ Area (A/mm$^2$) | Trip temp. (° C.) |
|---|---|---|---|---|---|---|
| Em. 1 | 0.0115 | 3 × 5 | 5.05 | 3.16 | 0.211 | 94.7 |
| Em. 2 | 0.0062 | 3 × 5 | 5.4 | 3.98 | 0.265 | 84.6 |
| Em. 3 | 0.0062 | 2.3 × 2.3 | 5.02 | 3.36 | 0.635 | 93.8 |
| Em. 4 | 0.0095 | 2.5 × 3 | 4.2 | 2.43 | 0.324 | 94.5 |
| Em. 5 | 0.013 | 2.5 × 3 | 3.03 | 1.97 | 0.263 | 89.4 |
| Em. 6 | 0.0064 | 2.5 × 3 | 4.5 | 2.52 | 0.336 | 93.8 |
| Comp. 1 | 0.0054 | 3 × 5 | 5.6 | 3.7 | 0.247 | 109.9 |
| Comp. 2 | 0.0104 | 2.5 × 3 | 4.2 | 2.76 | 0.368 | 116.4 |
| Comp. 3 | 0.0144 | 2.5 × 3 | 3.18 | 1.1 | 0.146 | 85.2 |
| Comp. 4 | 0.0127 | 2.5 × 3 | 2.73 | 0.93 | 0.124 | 81.5 |
| Comp. 5 | 0.0112 | 2.5 × 3 | 3.8 | 1.43 | 0.191 | 96.2 |

The volumetric resistivity of the PTC material layer 11 is determined by the following equation $\rho=R\times A/L$, where R is resistance of the PTC material layer 11, A is an area of the PTC material layer 11, and L is the thickness of the PTC material layer 11. For example, according to data of Em. 1 in Table 2, R is 0.0115Ω, A is 3×5 mm$^2$, and L is 0.3 mm, and therefore the volumetric resistivity can be calculated $\rho=R\times A/L=0.0115\times(15/0.3)=0.575$ Ω-mm=0.058 Ω-cm.

According to Tables 1 and 2, the volumetric resistivity of the PTC material layer 11 is less than 0.2 Ω-cm. The crystalline polymer comprises 10 to 60%, or 15%, 20%, 30%, 40%, 50% in particular, by volume of the PTC material layer 11. The conductive ceramic fillers have volumetric resistivity less than 500 μΩ-cm and are dispersed in the crystalline polymer. The conductive ceramic fillers comprise 40-70%, or 45%, 50%, 55%, 60%, 65% in particular, by volume of the PTC material layer 11. The crystalline low-molecular weight organic compound has a molecular weight less than 5000, and comprises 6-30%, or 8%, 12%, 15%, 20%, 25% in particular, by volume of the PTC material layer 11. The hold current at 60° C. divided by a covered area of the PTC device 10 is greater than 0.2 A/mm$^2$, or greater than 0.25, 0.3, 0.35 A/mm$^2$ in particular. The trip temperature is less than 95° C., or less than 90° C., 85° C. in particular.

The PTC device 10 of the present application has low initial volumetric resistivity, and the volumetric resistivity at room temperature is around $10^{-3}$-$10^{-1}$ Ω-cm. When trip event occurs, the resistance increases significantly. The resistance jump is approximately $10^3$ times the original value.

For all the embodiments, the hold current at 60° C. divided by the covered area is greater than 0.2 A/mm$^2$, the hold current at 60° C. is 40-95% of the hold current at 45° C., and trip temperature is less than 95° C. In contrast, for the comparative examples 3-5, the unrecrystallized wax, i.e., low-molecular weight organic compound, has a melting temperature distribution range larger than 20° C., the hold current per unit area at 60° C. does not exceed 0.2 A/mm$^2$, and the hold current at 60° C. is less than 40% of the hold current at 25° C. Moreover, the comparative examples 1 and 2, which do not use low-molecular weight organic compound, have trip temperatures greater than 105° C., and thus are not suitable for low-temperature applications. In other words, the compositions without crystalline low-molecular weight organic compound or with crystalline low-molecular weight organic compound which has overbroad melting temperature distribution range cannot meet the aforesaid hold current and trip temperature requirements.

Because the conductive ceramic fillers have very low volumetric resistivity (<500 μΩ-cm), the PTC composition containing the same can obtain relatively low volumetric resistivity. The PTC composition of low volumetric resistivity normally cannot perform good voltage endurance, and therefore the PTC composition may add non-conductive fillers to improve voltage endurance, flame retardant behavior and anti-arcing performance. The non-conductive fillers may comprise magnesium oxide, magnesium hydroxide, aluminum oxide, aluminum hydroxide, boron nitride, aluminum nitride, calcium carbonate, magnesium sulfate, barium sulfate or mixtures thereof. The non-conductive fillers comprises 0.5-5% by weight of the PTC composition. The non-conductive fillers have particle sizes around 0.05 to 50 μm. The non-conductive fillers also can improve resistance repeatability, and diminish resistance jump R1/Ri to less than 3, where Ri is an initial resistance, and R1 is resistance measured at one hour after tripping and returning to room temperature.

In addition to the above embodiments, the crystalline polymer generally comprises thermoplastic polymer, thermosetting polymer or mixtures thereof.

The thermoplastic polymer may comprise polyolefin such as polyethylene, olefin polymer such as ethylene-vinyl acetate copolymer and ethylene-acrylic acid copolymer, halogenated polymer, polyamide, polystyrene, polyacrylonitrile, polyethylene oxide, polyacetal, thermoplastic modified celluloses, polysulfone, thermoplastic polyester such as PET, poly(ethyl acrylate), poly(methyl methacrylate), and thermoplastic elestomer. For examples, high-density polyethylene (HDPE), low-density polyethylene (LDPE), medium-density polyethylene, ethylene-ethyl acrylate copolymer, ethylene-vinyl acetate copolymer, ethylene-acrylic acid copolymer, poly(vinylidene fluoride), vinylidene fluoride-tetrafluoroethylene-hexafluoropropylene copolymer. The thermoplastic polymer preferably contains polyolefin such as polyethylene.

The thermosetting polymer comprises, but is not limited to, epoxy resin, unsaturated polyester resin, polyimide, polyurethane, phenolic resin, silicone resin.

Epoxy resins are oligomers having reactive epoxy end groups (with a molecular weight of several hundred to several ten thousand) cured or crosslinked with various curing agents, and are generally divided into glycidyl ether type (as typified by bisphenol A), glycidyl ester type, glycidyl amine type and alicyclic type. In certain applications, trifunctional or multi-functional epoxy resins may be used. Epoxy resins of the glycidyl ether type, especially bisphenol A type are preferably used in the practice of the present application. The epoxy resins preferably have an epoxy equivalent of about 100 to 500. The curing agents are divided into addition polymerization, catalyst and condensation types, depending on the reaction mechanism. Curing agents of the addition polymerization type themselves add on epoxy or hydroxyl groups, and include polyamines, acid anhydrides, polyphenols, polymercaptans and isocyanates. Catalyst type curing agents are to catalyze polymerization between epoxy groups and include tertiary amines and imidazoles. Curing agents of the condensation type achieve curing through condensation with hydroxyl groups and include phenolic resins and melamine resins. In practice, curing agents of the addition polymerization type, especially polyamines and acid anhydrides are preferred curing agents for bisphenol A type epoxy resins. Curing conditions may be determined appropriately.

Unsaturated polyester resins are polyesters composed mainly of an unsaturated dibasic acid or dibasic acid with a polyhydric alcohol (having a molecular weight of about 1,000-5,000), dissolved in a vinyl monomer serving for crosslinking, which are cured using as a polymerization initiator an organic peroxide such as benzoyl peroxide. For curing, a polymerization accelerator may be optionally used in combination. With respect to the starting reactants to the unsaturated polyesters, preferred unsaturated dibasic acids include maleic anhydride and fumaric acid; preferred dibasic acids include phthalic anhydride, isophthalic acid, and terephthalic acid; and preferred polyhydric alcohols include propylene glycol and ethylene glycol. Suitable vinyl monomers include styrene, diallyl phthalate, and vinyl toluene.

Polyimide resins are generally divided into condensation and addition types depending on their preparation process. Preferred polyimides of the addition polymerization type are bismaleimide type polyimides, which can be cured by homopolymerization, reaction with other unsaturated bonds, Michael addition reaction with aromatic amines, or Diels-Alder reaction with dienes. Preferred in the practice are bismaleimide type polyimide resins resulting from addition reaction of bismaleimides with aromatic diamines. A suitable aromatic diamine is diaminodiphenyl methane.

Polyurethane is obtained by addition polymerization reaction of polyisocyanate with polyol. Suitable polyisocyanates include aromatic and aliphatic ones, preferably aromatic ones, for example, 2,4- or 2,6-tolylene diisocyanate, diphenylmethane diisocyanate and naphthalene diisocyanate. Suitable polyols include polyether polyols such as polypropylene glycol, polyester polyols and acrylic polyols, with polypropylene glycol being preferred.

Phenolic resins may be obtained by reacting phenols with aldehydes such as formaldehyde and generally divided into novolac and resol types depending on the synthesis conditions. Novolac type phenolic resins produced in the presence of acidic catalysts are cured by heating along with a crosslinking agent such as hexamethylene tetramine. Resol type phenolic resins produced in the presence of basic catalysts are cured by heating alone or in the presence of acidic catalysts.

Silicone resins include silicone resins comprising recurring siloxane bonds and primarily produced by hydrolysis or polycondensation of organohalosilanes; modified silicone resins such as alkyd-, polyester-, acrylic-, epoxy-, phenol-, urethane- and melamine-modified silicone resins; silicone rubbers obtained by crosslinking linear polydimethylsiloxane or copolymers thereof with organic peroxides or the like; and room-temperature vulcanizable silicone rubbers of the condensation or addition type.

The trip event of a PTC device is caused by way of expansion of crystalline polymer contained therein, thereby increasing the resistance of the PTC device. The crystalline low-molecular weight organic compounds usually have higher crystallinity than polymers, so that the low-molecular weight organic compound has more accurate melting temperature and narrow melting temperature distribution range and the resistance increases at a higher rate as temperature rises. The trip temperature at which resistance increases can be easily controlled by the use of two or more low-molecular weight organic compounds having different melting points. Although polymers, which are likely to take a supercooled state, exhibit a hysteresis phenomenon that the temperature at which the original resistance is resumed upon cooling is lower than the operating temperature upon heating, the use of low-molecular weight organic compound alleviates the hysteresis. In the case of crystalline polymers, the melting point and the trip or operating temperature can be changed by altering the molecular weight or degree of crystallization or by copolymerizing with comonomers, but with a concomitant change of crystalline state which may incur unsatisfactory PTC characteristics. This problem becomes more obvious when the trip temperature is set at 100° C. or lower.

The low-molecular weight organic compound of the present application is crystalline material and has a molecular weight less than 5000, preferably less than 3000 or 2000, more preferably less than 1000, and most preferably about 200-800. Preferably it is solid at room temperature, i.e., about 25° C.

The low-molecular weight organic compounds may include waxes (for example, petroleum waxes such as paraffin wax and microcrystalline wax, and natural waxes such as vegetable waxes, animal waxes and mineral waxes), and oils and fats (for example, those known as fat or solid fat). Waxes, oils and fats contain components such as hydrocarbons (e.g., alkane series straight-chain hydrocarbons having 22 or more carbon atoms), fatty acids (e.g., fatty acids of alkane series straight-chain hydrocarbons having 12 or more carbon atoms), fatty esters (e.g., methyl esters of saturated fatty acids obtained from saturated fatty acids having 20 or more carbon atoms and lower alcohols such as methyl alcohol), amide, fatty acid amides (e.g., unsaturated fatty acid amides such as oleic acid amide and erucic acid amide), aliphatic amines (e.g., aliphatic primary amines having 4, 16 or more carbon atoms), higher alcohols (e.g., n-alkyl alcohols having 12, 16 or more carbon atoms), and chlorinated paraffin. These compounds may be used alone or in admixture as the crystalline low-molecular weight organic compound. In consideration of dispersion of the other ingredients in the polymer matrix, the crystalline low-molecular weight organic compound may be selected as appropriate while taking into account the polarity of the polymer matrix. In an embodiment, preferred low-molecular weight organic compounds are petroleum waxes.

According to an embodiment of the present application, one or two low-molecular weight organic compounds may be used according to operation temperatures. The melting point of the low-molecular weight organic compound may be 40-100° C., preferably about 70-110° C. and more preferably about 75-100° C. The crystalline low-molecular weight organic compounds, for instance, include paraffin waxes, microcrystalline waxes, fatty acids such as behenic acid, stearic acid and palmitic acid, fatty acid esters such as methyl arachidate, and fatty acid amides such as oleic acid amide. Also included materials having a melting point of 100-200° C. are polyethylene waxes, stearic acid amide, behenic acid amide, N,N'-ethylene-bislauric acid amide, N,N'-dioleyladipic acid amide, and N,N'-hexamethylenebis-12-hydroxystearic acid amide.

In an embodiment, the crystalline low-molecular weight organic compound has molecular formula $R^1$—C(O)—NH—$R^2$, where $R^1$, $R^2$ are saturated alkyl having between 4-24 carbon atoms. In an embodiment, the crystalline low-molecular weight organic compound has the molecular formula $R^1$—C(O)—NH—$R^2$, where $R^1$ is aryl having between 4-24 carbon atoms, and $R^2$ is saturated alkyl having between 4-24 carbon atoms. For example, $R^2$ is $CH_3(CH_2)_{15}$ or $CH_3(CH_2)_{17}$.

In an embodiment, the crystalline low-molecular weight organic compound has the molecular formula $R^1$—C(O)—NH—$R^2$, where $R^1$ is saturated alkyl having between 4-24 carbon atoms, and $R^2$ is aryl having between 4-24 carbon atoms. For example, $R^1$ is $CH_3(CH_2)_{10}$, $CH_3(CH_2)_{12}$ or $CH_3(CH_2)_{14}$.

The PTC device 10 using the aforesaid material has a trip temperature about 70-95° C.

An appropriate amount of the crystalline low-molecular weight organic compound is 0.25 to 4 times, preferably 0.5 to 2 times the total weight of the crystalline polymer (inclusive of the curing agent). If this mixing proportion becomes lower or the content of the low-molecular weight organic compound becomes low, it may be unable to provide a satisfactory resistance change rate. In contrast, if this mixing proportion becomes higher or the content of the low-molecular weight organic compound becomes high, the PTC body is easily deformed upon melting of the low-molecular weight organic compound and it may become difficult to mix with conductive ceramic fillers.

The electrode layers 12 of the PTC device may connect to two nickel plates as an assembly by soldering, reflow, or spot-welding, so as to form an axial-leaded, radial-leaded, terminal or surface-mountable type device.

Because the crystalline low-molecular weight organic compound has higher degree of crystallization, the PTC device can trip within accurate temperature range at which the resistance increases dramatically. Accordingly, the PTC device of the present application is suitable for the applications of temperature sensors.

The above-described embodiments of the present invention are intended to be illustrative only. Numerous alternative embodiments may be devised by persons skilled in the art without departing from the scope of the following claims.

We claim:

1. A PTC device, comprising:

two electrode layers; and a PTC material layer having a volumetric resistivity less than 0.2 μΩ-cm and being laminated between the two electrode layers, comprising:

a crystalline polymer comprising thermoplastic polymer, thermosetting polymer or mixtures thereof;

conductive ceramic fillers dispersed in the crystalline polymer and having a volumetric resistivity less than 500 μΩ-cm, and comprising 40-70% by volume of the PTC material layer;

a crystalline low-molecular weight organic compound having a molecular weight less than 5000 and comprising 6-30% by volume of the PTC material layer, the crystalline low-molecular weight organic compound having a melting temperature in the range of 70-110° C. and a melting temperature distribution range less than 20° C.;

wherein a hold current of the PTC device at 60° C. divided by a covered area of the PTC device is greater than 0.2 $A/mm^2$ and the hold current at 60° C. is 40-95% of a hold current at 25° C.;

wherein the PTC device has a trip temperature less than 95° C.

2. The PTC device of claim 1, wherein the crystalline low-molecular weight organic compound has a melting point in the range 75-100° C.

3. The PTC device of claim 1, wherein the crystalline low-molecular weight organic compound comprises waxes, oils, fats or mixtures thereof and the melting temperature distribution range is less than 10° C.

4. The PTC device of claim 1, wherein the crystalline low-molecular weight organic compound is selected from the group consisting of paraffin waxes, microcrystalline waxes, vegetable waxes, animal waxes, mineral waxes, fatty acids, stearic acid, palmitic acid, fatty esters, fatty acid esters, polyethylene waxes, stearic acid amide, behenic acid amide, N,N'-ethylene-bislauric acid amide, N,N'-dioleyladipic acid amide, N,N'-hexamethylenebis-12-hydroxystearic acid amide and mixtures thereof.

5. The PTC device of claim 1, wherein the crystalline low-molecular weight organic compound is selected from the group consisting of hydrocarbons, fatty acids, fatty esters, amide, fatty acid amides, aliphatic amines, n-alkyl alcohols having 12 or more carbon atoms, and chlorinated paraffin.

6. The PTC device of claim 5, wherein the aliphatic amines comprise aliphatic primary amines having 4 or more carbon atoms.

7. The PTC device of claim 1, wherein the crystalline low-molecular weight organic compound comprises recrystallized waxes having a single melting point.

8. The PTC device of claim 1, wherein the crystalline low-molecular weight organic compound comprises a material having a structure $R^1$—C(O)—NH—$R^2$, where $R^1$, $R^2$ are saturated alkyl having between 4-24 carbon atoms; or $R^1$ is aryl having between 4-24 carbon atoms and $R^2$ is saturated alkyl having between 4-24 carbon atoms; or $R^1$ is saturated alkyl having between 4-24 carbon atoms and $R^2$ is aryl having between 4-24 carbon atoms.

9. The PTC device of claim 1, wherein the conductive ceramic fillers comprise titanium carbide, tungsten carbide, vanadium carbide, zirconium carbide, niobium carbide, tantalum carbide, molybdenum carbide, hafnium carbide, titanium boride, vanadium boride, zirconium boride, niobium boride, molybdenum boride, hafnium boride, zirconium nitride, titanium nitride, solid solution thereof or mixtures thereof.

10. The PTC device of claim 1, wherein the crystalline low-molecular weight organic compound has a molecular weight less than 3000.

11. The PTC device of claim 1, wherein the trip temperature is obtained by applying 6V and 1 A.

12. The PTC device of claim 1, wherein the thermoplastic polymer comprises polyolefins, ethylene-vinyl acetate copolymer, ethylene-acrylic acid copolymer, halogenated polymer, polyamide, polystyrene, polyacrylonitrile, polyethylene oxide, polyacetal, thermoplastic modified celluloses, polysulfone, thermoplastic polyester, poly(ethyl acrylate), poly(methyl methacrylate), thermoplastic elestomer, and mixtures thereof.

13. The PTC device of claim 1, wherein the thermosetting polymer is selected from the group consisting of epoxy resins, unsaturated polyester resins, polyimide, polyurethane, phenolic resins, and silicone resins.

* * * * *